US005297633A

United States Patent [19]

Snider et al.

[11] Patent Number: 5,297,633

[45] Date of Patent: Mar. 29, 1994

[54] INFLATABLE PACKER ASSEMBLY

[76] Inventors: Philip M. Snider, 12102 Rocky Lake Dr., Houston, Tex. 77070; Michael J. Dietrich, 23214 Cinco Park Place Ct., Katy; Vel Berzin, 12015 Circle Dr. E., Houston, both of Tex. 77071

[21] Appl. No.: 811,209

[22] Filed: Dec. 20, 1991

[51] Int. Cl.[5] ..... E21B 33/127

[52] U.S. Cl. ..... 166/387; 166/106; 166/122; 166/187; 166/191

[58] Field of Search ..... 166/387, 122, 187, 140, 166/106, 191

[56] References Cited

U.S. PATENT DOCUMENTS

| | | | |
|---|---|---|---|
| 2,286,365 | 6/1942 | Lane | 166/187 X |
| 2,633,200 | 3/1953 | Humason | 166/187 X |
| 2,859,828 | 11/1958 | Williams | 166/106 X |
| 2,942,669 | 6/1960 | Mounce et al. | 166/187 |
| 3,032,116 | 5/1962 | Barry | 166/187 |
| 3,204,697 | 8/1965 | Gant | 166/187 X |
| 3,460,624 | 8/1969 | Aitken et al. | 166/187 X |
| 3,460,625 | 8/1969 | Hart et al. | 166/387 X |
| 3,527,296 | 9/1970 | Malone | 166/122 |
| 3,575,237 | 4/1971 | Malone | 166/152 |
| 3,575,238 | 4/1971 | Shillander | 166/187 |
| 3,690,375 | 9/1972 | Shillander | 166/187 |
| 3,876,000 | 4/1975 | Nutter | 166/106 |
| 3,876,003 | 4/1975 | Kisling, III | 166/250 |
| 4,320,800 | 5/1982 | Upchurch | 166/106 |
| 4,750,563 | 6/1988 | Baugh | 166/382 |
| 4,915,172 | 4/1990 | Donovan et al. | 166/50 X |

*Primary Examiner*—Hoang C. Dang

[57] ABSTRACT

An inflatable packer assembly for use in a subterranean well bore to isolate an interval of the well bore and/or adjacent subterranean formation for treatment. The assembly comprises a hanger assembly, a fluid piston assembly and at least one inflatable packer. As constructed and positioned in the well bore, the hanger assembly and fluid piston assembly are sufficiently distant from the interval to be treated to inhibit being stuck in the well bore. By lowering and raising the tubing or drill string from which the inflatable packer assembly is suspended, the fluid piston assembly pumps well bore fluid into and from the packer to respectively inflate and deflate the packer. In this manner, the packer can be repeatedly inflated, deflated and repositioned within a well bore to treat successive intervals of the well bore.

21 Claims, 8 Drawing Sheets

INFLATABLE PACKER ASSEMBLY

BACKGROUND OF THE INVENTION

1. Field of the Invention

The present invention relates to an inflatable packer assembly for use in a subterranean well bore, and more particularly, to a packer assembly including an inflatable packer and a fluid piston for inflating the packer and to methods of utilizing such assembly.

2. Background Information

Isolation of a cased or uncased interval of a well bore is often desirable to permit the isolated well bore interval and/or a corresponding interval of the subterranean formation penetrated by the well bore to be selectively treated. The cased interval of a subterranean well bore which is isolated is normally perforated, although occasionally it may be desirable to isolate an unperforated interval of casing, e.g., to test the unperforated interval for fluid leaks.

Conventionally, a packer is positioned at the lower end of a tubing string and is usually secured against axial movement within a well bore by means of slips which are mechanically expanded, such as by means of a wedge, into contact with casing. Once positioned in the well bore, subsequent rotation and downward movement of the tubing string mechanically expands the packer into contact with the casing. These conventional, mechanically set packers are normally sized slightly less than, e.g. $\frac{1}{8}$ to $\frac{1}{4}$ inch, the internal diameter of the casing within which they are positioned. Further, the sealing element of a conventional mechanical packer is relatively short, e.g., one foot or less. Upon expansion, the expanded packer element engages and seals the annulus between the tubing string and casing against fluid flow. Use of such conventional mechanically inflatable packer assemblies to isolate within a perforated casing interval for selective treatment has proved troublesome. The relatively short length of the conventional packer sealing element permits unconsolidated matrix, i.e., sand, from the subterranean formation which is penetrated by the well bore to flow through that portion of a perforated interval which is located above the inflated packer and be deposited on top of the packer. Upon completion of a given operation, the mechanical packer is retracted. However, the extremely close tolerance between the external diameter of the retracted packer and the internal diameter of the casing often permits sand and/or other objects within the well bore to become lodged between the retracted packer and/or the retracted slips and the casing thereby causing the mechanical packer to become stuck within the well bore. Retrieval of a stuck mechanical packer is difficult, time consuming and expensive. Accordingly, mechanical packers are normally not employed in a perforated interval of casing or an uncased section of a well bore.

Conventional inflatable packers have been proposed for use in lieu of mechanical packers to isolate a given cased or uncased well bore interval. Inflatable packers employ valve assemblies which in conjunction with fluid pressure within the well bore inflate and deflate the packer element. Multiple inflation of such packers is difficult to obtain due to structural constraints of the valve assembly and difficulties in ascertaining and obtaining requisite tubing fluid pressures. Further, such inflatable packers conventionally are inflated with fluid housed within a tubing string and isolated from well bore fluids. Thus, changes in temperature of and/or hydrostatic pressure exerted upon such isolated tubing fluid expand the fluid creating problems due to overinflation of the packer. Thus, a need exists for an inflatable packer assembly which is capable of being repeatedly inflated and deflated and repositioned within a cased or uncased section of a subterranean well bore.

Accordingly, it is an object of the present invention to provide an inflatable packer assembly which can be easily inflated and deflated using well bore fluid and repositioned within a well bore.

It is another object of the present invention to provide an inflatable packer assembly having a fluid piston which can be manipulated to inflate a packer element and which is located together with a hanger assembly at a sufficient distance from the packer element to ensure against the slips of the hanger assembly and the fluid piston becoming stuck within the casing due to debris flowing into the well bore.

It is also an object of the present invention to provide an inflatable packer assembly which can be repeatedly inflated and repositioned within a well bore without being damaged due to overinflation.

It is a further object of the present invention to provide an inflatable packer assembly which can be utilized to inflate more than one packer in a well bore.

It is a still further object of the present invention to provide a process for treating a relatively long interval of a well bore.

SUMMARY OF THE INVENTION

To achieve the foregoing and other objects, and in accordance with the purposes of the present invention, as embodied and broadly described herein, one characterization of the present invention may comprise an inflatable packer assembly for use in an enclosure having a substantially tubular configuration. The assembly comprises securing means for securing the assembly against axial movement within the substantially tubular enclosure, inflatable means, pump means for mechanically pumping fluid which is initially present within the enclosure to and from said inflatable means, positioning means and means for axially transporting fluid through the assembly. The inflatable means forms a fluid tight seal between the assembly and the enclosure upon being inflated thereby substantially preventing fluid flow through an annulus defined between the assembly and the enclosure. The positioning means fixedly positions the securing means and the pump means at a location which is sufficiently distant from the inflatable means to inhibit material entering the enclosure from contacting and causing the securing means and pump means to become stuck within the enclosure.

In another characterization of the present invention, a process is provided for treating an interval of a well bore which is in fluid communication with a subterranean formation. In accordance with this process, an inflatable packer assembly is secured to a string of tubing. The assembly comprises securing means for securing the assembly against axial movement within the well bore, inflatable means for forming a fluid tight seal between the assembly and the well bore upon being inflated thereby substantially preventing fluid flow through an annulus defined between the assembly and the well bore, and pump means for mechanically pumping fluid which is initially present within the well bore to and from the inflatable means. The inflatable means is positioned adjacent the well bore interval to be treated. The assembly is constructed such that the securing means and the pump means are correspondingly positioned at a location distant from the interval to be treated. The securing means is expanded into contact with the well bore by manipulation of the tubing string to secure the assembly against axial movement within the well bore. The tubing string is manipulated to pump fluid from the pump means to the inflatable means thereby inflating the inflatable means to form a fluid tight seal and to isolate the well bore interval. Thereafter, a treating fluid is injected through the assembly and into contact with the well bore interval to be treated.

BRIEF DESCRIPTION OF THE DRAWINGS

The accompanying drawings, which are incorporated in and form a part of the specification, illustrate the embodiments of the present invention and, together with the description, serve to explain the principles of the invention. Throughout the drawing figures, like reference numerals indicate like elements.

In the drawings.

DETAILED DESCRIPTION OF THE PREFERRED EMBODIMENTS

Figure 1A:
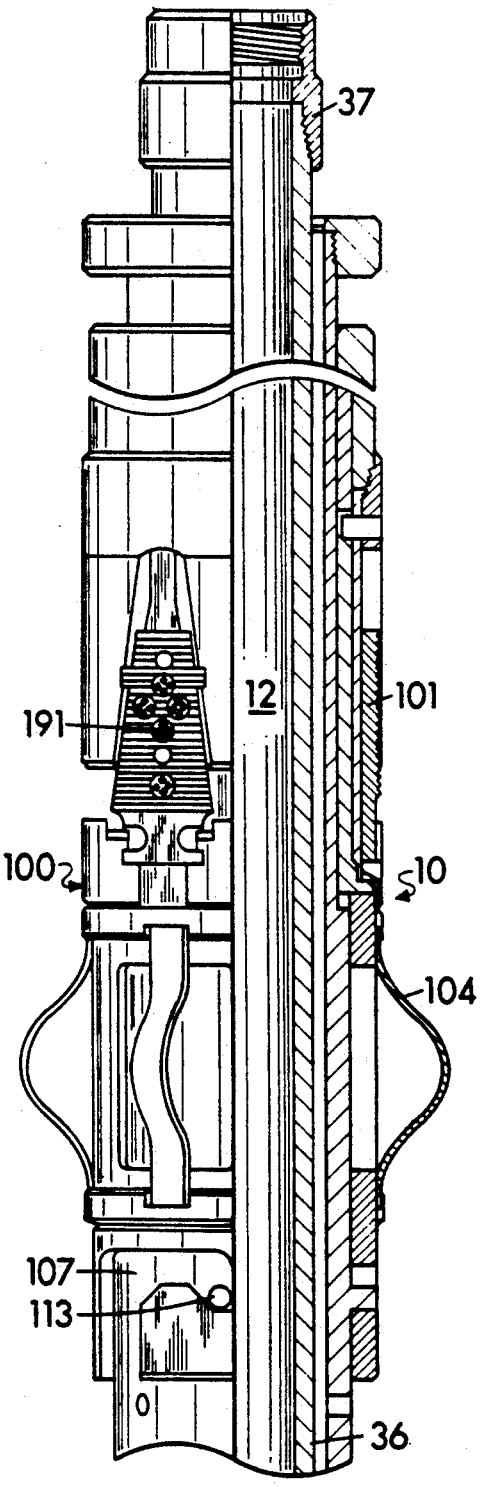
FIGS. 1A, 2A, 3A, and 4A are partial cross sectional views which, as combined in the sequence noted, illustrate the inflatable packer assembly of the present invention as assembled and run into a well bore.

Referring to FIGS. 1A, 2A, 3A and 4A, the inflatable packer assembly of the present invention is illustrated generally as 10 and comprises a hanger assembly 100, a fluid piston assembly 20, and an inflatable packer 120. Fluid piston assembly 20 comprises inner and outer generally tubular members 21, 22 which are telescopically arranged so as to define a generally cylindrical fluid chamber 39 therebetween. Generally tubular members 21, 22 are releasably secured, e.g., by screw threads, with a lower valve subassembly 60.

Outer generally tubular member 22 is comprised of generally tubular members 23, 24 and 25 which are releasably secured together by any suitable means, such as screw threads. The upper end of tubular member 23 is releasably secured to the lower end of hanger assembly 40 by means of internal threads. Adjacent the internal threads, the inner surface of tubular member 23 is tapered to provide a shoulder or seat 26 through which a plurality of bores 27 are provided. At two distant locations along the length of member 23, a plurality of circumferentially arranged bores 28 are provided. Also an automatic "J" lug 38 is positioned through a bore through member 23 and is secured therein by means of tubular member 24 which is releasably secured to member 23 by any suitable means, such as threads 30.

Tubular member 24 is provided with two sets of circumferentially arranged bores or ports 31 therethrough. The external diameter of member 24 is recessed to receive a generally tubular screen 32 and retaining rings 46 and 47 which are secured around member 24 by means of generally tubular member 25. Screen 32 covers one set of circumferentially arranged ports 31.

Tubular member 25 is secured to tubular member 24 by any suitable means, such as threads 33. Tubular member 25 is provided with a bore 34 therethrough which is in fluid communication valve subassembly 60 by means of axial fluid passageway 35. The other end of tubular member 25 and generally tubular member 21 are releasably secured to valve subassembly 60.

Figure 2A:
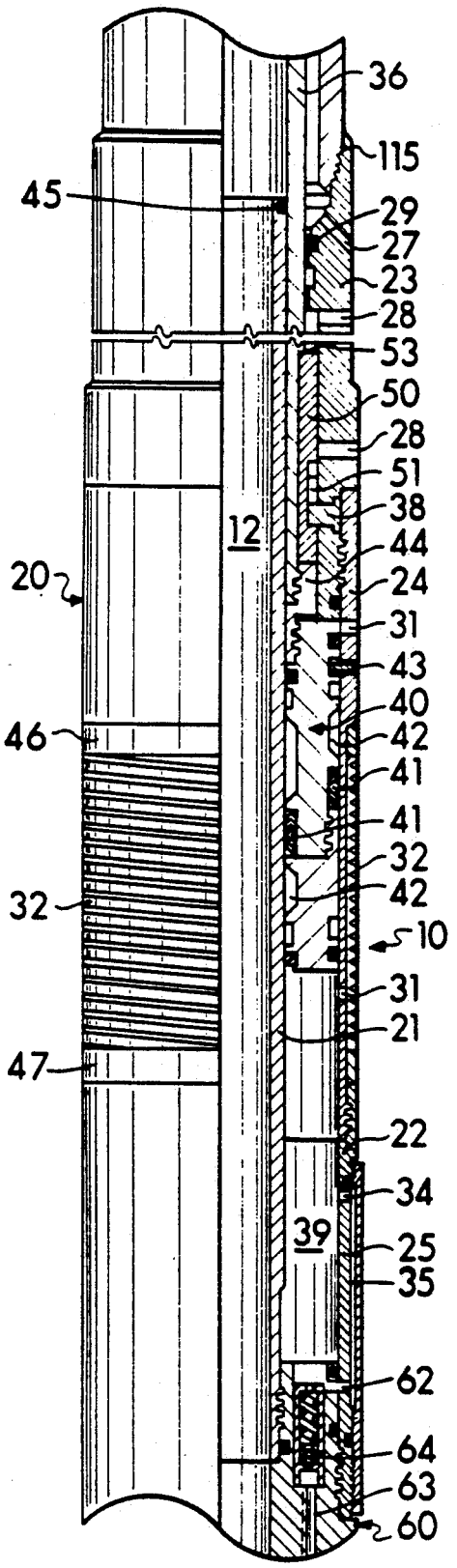

Fluid piston assembly 20 is further comprised of a fluid piston 40 having a plurality of generally annular seals 41 positioned within grooves in both the inner and outer face thereof. Fluid piston 40 is generally configured as an annular sleeve. Piston 40 is further provided with circumferentially extending, generally annular grooves 42 formed in both the inner and outer faces of piston 40. Piston 40 is positioned within fluid chamber 39 and is releasably secured to tubular member 36, e.g., by collar 44, and to tubular member 24 by means of shear pin 43 (FIG. 2A). Tubular member 36 extends through fluid chamber 39 and through the interior of hanger assembly 40. The upper end of tubular member 36 is provided with generally annular collar 37 which is internally threaded. Collar 37 is threaded to a conventional tubing or drill string (not illustrated) which extends to a wellhead at the surface of the earth. O-ring 29 in outer tubular member 21 and o-ring 45 in outer tubular member 22 seal against fluid flow between tubular member 36 and inner and outer tubular members 21, 22 thereby defining the upper limit of fluid chamber 39. An automatic "J" sleeve 50 is positioned around tubular member 36 and is secured to tubular member 36 by means of shoulder 53 on tubular member 36 and collar 44. Automatic "J" sleeve 50 is provided with an endless "J" slot 51 on the outer surface thereof. A lug 38 which is secured to the outer tubular member 21 extends inwardly and is received within endless J-slot 51. Outer tubular member 21 is provided with ports 31 such that fluid communication exists between fluid chamber 39 and the annulus defined between assembly 10 and the well bore tubular, i.e., the casing, into which the assembly is positioned during operation.

Figure 1B:
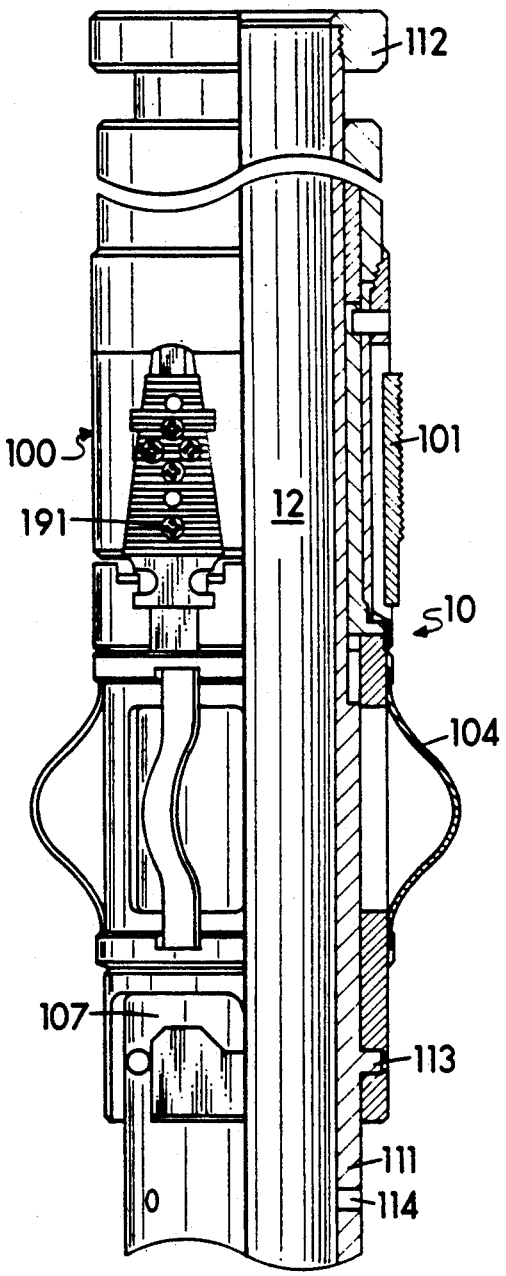
FIGS. 1B, 2B, 3B, and 4B are partial cross sectional views which, as combined in the sequence noted, illustrate the inflatable packer assembly of the present invention as positioned in a well bore and fully inflated.

Hanger assembly 100 may be any conventionally available hanger assembly which is mechanically set, e.g., by rotation of the tubing string, such as disclosed in U.S. Pat. No. 4,750,563 which is incorporated herein by this reference. As illustrated in FIGS. 1A and 1B, hanger assembly 100 comprises a plurality of slip members 101, drag springs 104 and J-slot 107. Drag springs 104 extend outwardly from hanger assembly 100 and are configured and sized to engage the well bore casing (not illustrated) with enough friction to permit rotation of tubular member 111 within hanger assembly 100. Tubular member 111 extends through hanger assembly 100 and is provided at the upper end thereof with a collar 112. The lower end of tubular member 111 is releasably secured to outer tubular member 22 by means of, e.g., threads 115. A lug 113 extends outwardly from member 111 and is received within J-slot 107. A plurality of ports 114 are provided through tubular member 111.

Valve sub-assembly 60 is generally tubular and has at least one unrestricted fluid passageway 61 extending therethrough. A port 62 provides fluid communication between at least one axial fluid passageway 35 in tubular member 25 and passageway 63 in valve subassembly 60. Passageway 63 is provided with a check valve 64 which permits fluid flow through passageway 63 in one direction and in a manner as hereinafter described. Check valve 64 may be any suitable spring loaded ball and seat valve which is designed such that a predetermined fluid pressure acting against the ball in one direction will unseat the ball and permit unidirectional fluid flow through fluid passageway 63 as will be evident to the skilled artisan. A portion of the exterior of valve subassembly 60 is recessed to receive a generally tubular screen 65 and retaining rings 66 and 67 which are secured around subassembly 60 by means of shoe 68. A port 69 provides fluid communication between passageway 63 and the exterior of screen 65. At least one second fluid passageway 160 is also provided through valve subassembly. Second fluid passageway 160 has a second check valve 161 which although similar in construction and function to check valve 64 is significantly smaller in size. Port 162 provides fluid communication between second fluid passageway 160 and the exterior of screen 65. Shoe 68 is releasably secured to outer tubing extension 163 by means of shear pin 150. Inner tubing extension 164 is threadably secured to the lower end of the body of valve sub-assembly 60.

The lower end of valve sub-assembly 60 is threadably secured to generally tubular, inner and outer spacing joints 151 and 70. The annulus 165 formed between inner and outer spacing joints 151 and 70 is in fluid communication with passageways 61 and 160 in valve sub-assembly 60. The number of tubular spacing joints utilized will depend upon, inter alia, whether the well bore into which the assembly of the present invention is utilized is cased or uncased, the interval of the well bore to be treated and the exact operation to be practiced. In general, the number of spacing joints should be selected to ensure that any unconsolidated formation material which should enter the well bore above inflated packer 120 during operation of the assembly would not contact fluid piston assembly 20 or hanger assembly 100 so as to impede or prevent their retraction and removal from the well bore after a given operation is completed. As a general rule, piston assembly 20 should be spaced about 50 to 200 feet above inflatable packer 120.

The lower end of the bottom spacing joint 70 is secured by means of a threaded collar 80 to generally tubular joint 81 which in turn is secured to male collar 82 having a plurality of bores 83 extending through the length thereof. Male collar 82 is also secured to inflatable packer 120. Inflatable packer 120 may be any conventional inflatable packer and is sized to be of sufficient length, e.g., 4–10 feet, to inhibit treatment fluid which is injected into a subterranean formation below inflated packer 120 from causing unconsolidated formation sand to flow into the well bore and be deposited upon inflated packer 120. Packer 120 has an uninflated outer diameter, e.g., 3½ to 5½ inches, which is significantly less than the inner diameter of the casing or uncased well bore, e.g., 6 to 7 inches, into which the packer is positioned so as to permit ready withdrawal of the uninflated packer.

Inflatable packer 120 comprises an upper housing 121 and a lower housing 122 to which inflatable elements 123 and 124 are secured in a manner as will be evident to the skilled artisan. Inflatable elements 123 and 124 are separated by a plurality of overlapping, metallic reinforcing ribs 125. Inflatable elements 123 and 124 are constructed from any suitable elastomeric material, e.g., rubber. Retaining ring 126 is releasably secured to lower housing 122 by means of threads. Retaining ring 126 has a plurality of O-rings 127 positioned within grooves formed in the inner surface thereof. The upper end of upper housing 122 is releasably secured to collar 128 to permit packer 120 to be secured to fluid piston assembly 20 by means of male collar 82.

Tubular joint 130 extends through inflatable packer assembly 120. The lower end of joint 130 is threadably engaged with a ball valve 132. Valve 132 comprises a valve body 133 having an axial bore 134 therethrough, an annular seat 135 positioned within the bore so as to receive a ball (not illustrated) and a shear pin 136 mated in threaded, aligned bores formed in body 133 and seat 135 to releasably secure seat 135 to body 133. The upper end of tubular joint 133 is releasably secured to male collar 82 by engagement with internal threads on collar 82. Lower housing 122 and retaining ring 126 are moved over tubular joint 130 in sealing engagement by means of O-rings 127. Thus, when packer 120 is inflated, housing 122 and retaining ring 126 move upwardly to compensate for the outward movement of packer elements 123 and 124 and reinforcing ribs 125.

Male collar 82 is also threaded to collar 140. O-rings 84 provided a fluid tight seal between collar 82 and joint 133 and collar 140. Collar 140 is threadably engaged with collar 142. An annular groove in collar 140 receives an O-ring 141 which provides a fluid tight seal between mated collars 140 and 142. Collar 142 is mated with seat 143 having a plurality of seals, such as O-rings 144, positioned within annular grooves formed in the inner surface thereof. Seat 143 is provided with a plurality of axial passageways 145 therethrough.

The inflatable packer assembly 10 of the present invention is assembled and run into the well bore by first securing inflatable packer 120 to male collar 82 and inserting tubular joint 130 through packer 120 and to male collar 82. Collars 140, 141 and seat 143 are secured together in a manner described above and collar 140 is secured to male collar 82. Thereafter, tubular joint 81 is mated with male collar 82 and collar 80 is mated with the other end of joint 81. The remaining components of assembly 10 are sequenced in a manner illustrated and described above and assembled in a manner as will be evident to the skilled artisan. The bottom spacing joint 70 is then mated with collar 80 as the bottom, inner tubular joint 151 is inserted through seat 143. The bottom, inner tubular joint 151 is free to rotate within seat 143 during assembly. O-rings 144 provide a fluid tight seal between components of inflatable packer assembly 10. Preferably, the bottom, inner tubular joint 151 has a polished exterior to assist in obtaining a fluid tight seal. As thus assembled, generally cylindrical fluid chamber 39 which is defined between inner and outer tubular members 21 and 22 is sized to receive fluid piston 40 and is in fluid communication with inflatable packer 120 by means of fluid passageways 83, 61, 165, and 145. If chamber 39 is not completely filled with well bore fluids during assembly, well bore fluids will enter and fill chamber 39 via port 31 and/or port 69, passageway 63 and check valve 64 as the inflatable packer assembly 10 is positioned for treatment of a well bore interval. Further, an internal axial fluid passageway 12 extends the entire length of the inflatable packer assembly 10 of the present invention. Thus, as assembly 10 is secured to a conventional tubing string and lowered or run into a well bore from the surface to the well bore interval to be treated, treating fluid can be injected into the tubing string and through inflatable packer assembly 10 via fluid passageway 12.

In operation, a ball (not illustrated) which is sized to pass through passageway 12 but sealingly engage annular seat 135 is dropped into passageway 12 of inflatable packer 10, preferably while only assembly 10 is positioned within a well bore from the surface. Thereafter, fluid is pumped into assembly 10 via passageway 12 under sufficient pressure to ensure against internal leakage from passageway 12. Once the assembly has been checked for leakage, fluid pressure is sufficiently increased to shear pin 136 and remove the ball and seat 135 from assembly 10. Inflatable packer assembly 10 is then secured to a tubing or drill string (not illustrated) by means of collar 37 on the upper end of tubular member 36 and is lowered within a well bore to a position adjacent the well bore interval of interest. Once suitably positioned within the well bore, the tubing string is raised to permit lug 113 to move upwardly within J-slot 107. The tubing string is then rotated from the surface until lug 113 rotates due to the friction of drag springs 104 as much as possible within J-slot 107, thereby permitting the tubing string to be lowered. As the tubing string is lowered, pin 43 shears thereby permitting tubular member 36 to also be lowered. As illustrated in FIG. 1B, drag springs 104 engage well bore casing (not illustrated) with sufficient friction to resist downward movement thereby causing slip members 101 to be forced or wedged outwardly into engagement with the casing (not illustrated) by means such as disclosed in U.S. Pat. No. 4,750,563. The weight of the tubing string imparts a significant force, e.g., 20,000 pounds force, to components of the inflatable packer assembly 10 during downward movement of the tubing string.

Figure 2B:
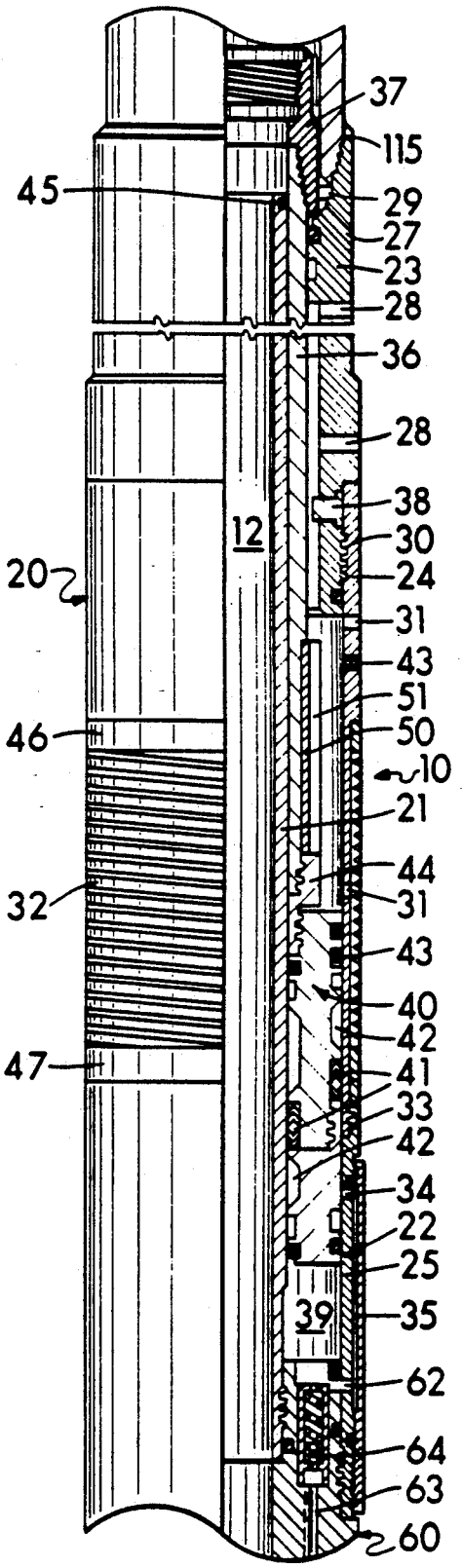
Figure 4A:
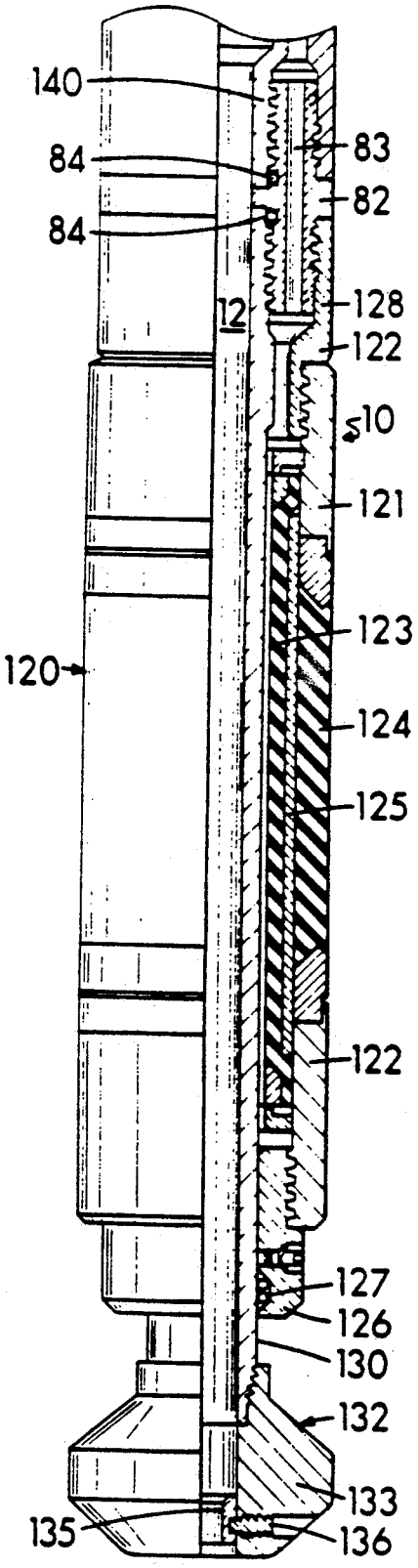
Figure 4B:
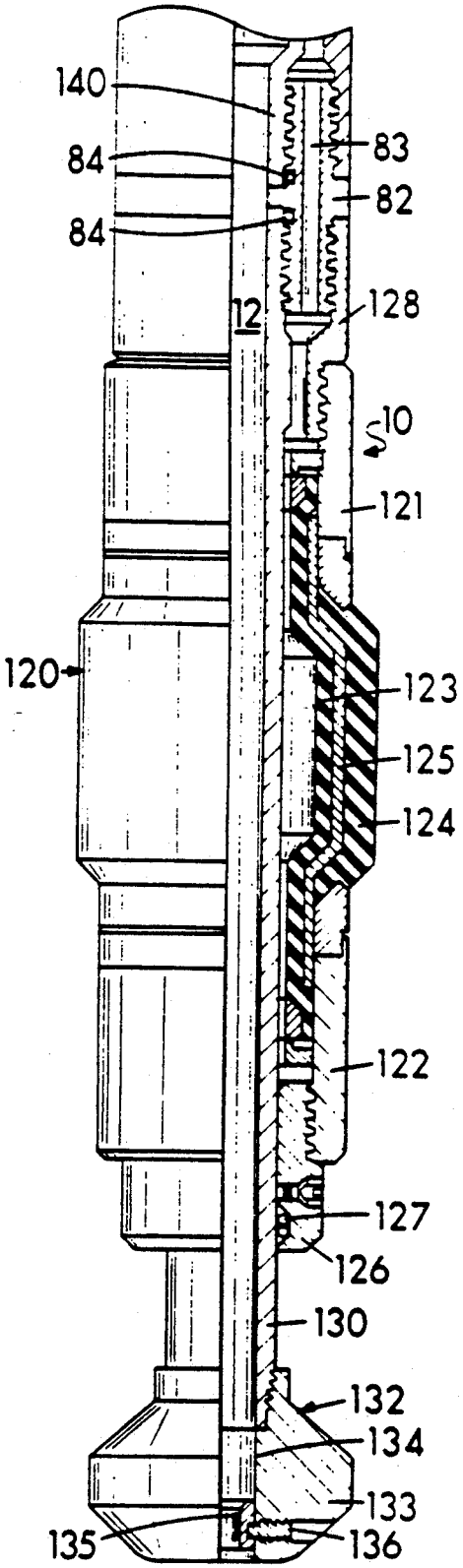
Figure 5:
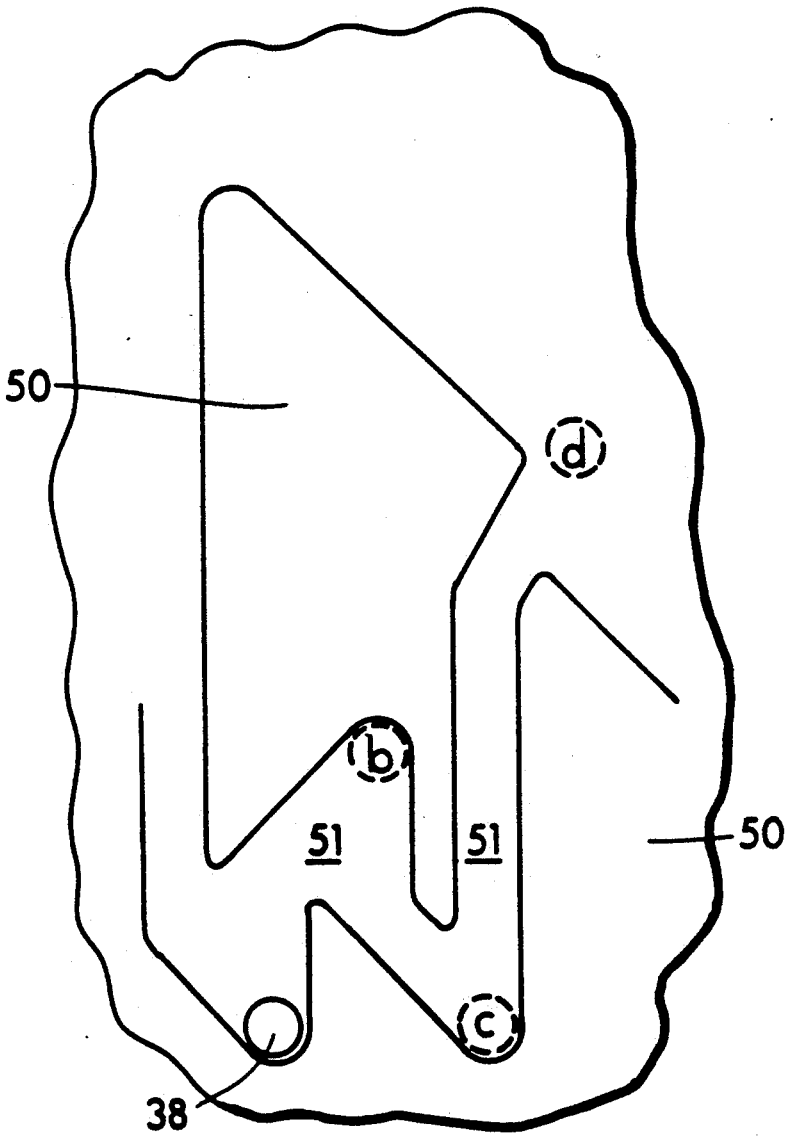
FIG. 5 is a laid out view of the automatic J-slot arrangement of FIGS. 2A and 2B.

While the slip members 101 of hanger assembly 100 are being set as described above, inner and outer tubular members 21, 22 and tubular member 36 are secured together by means of engagement of lug 38 on tubular member 23 within endless J-slot 51 in automatic "J" sleeve 50. An upward movement of the tubing or drill string to set slip members 101 causes lug 38 to assume position b within slot 51 as illustrated in FIG. 5. Once slip members 101 are set, the tubing string is sequentially lowered and raised to maneuver lug 38 through positions c and d within slot 51 as illustrated in FIG. 5. When lug 38 is in position d within endless J-slot 51, sleeve 50 is permitted to move downwardly with respect to lug 38, thus permitting downward movement of tubular member 36 and fluid piston 40 within fluid chamber 39. Subsequently lowering the tubing string causes fluid piston 40 to move slowly downwardly within chamber 39 to a position illustrated in FIG. 2B thereby forcing fluid from chamber 39 via fluid passageways 83, 61, 165, and 145 into packer 120 and inflating elements 123, 124 as illustrated in FIG. 4B. In this manner, fluid is forced from chamber 39 upon the downward movement of fluid piston 40 until inflating elements 123, 124 are expanded into contact with surrounding well bore walls or casing (not illustrated). Upon further downward movement of fluid piston 40, increasing fluid pressure is transmitted to second fluid passageway 160 and second check valve 161 by means of the fluid passageway defined by annulus 165. When a predetermined fluid pressure is exerted against second check valve 161 by further downward movement of fluid piston 40 in chamber 39, second check valve 161 opens thereby permitting fluid to flow through passageway 160, port 162 and screen 65 and into the annulus defined between assembly 10 of the present invention and the well bore walls or casing. In this manner, overinflation of and damage to inflating elements 123, 124 is inhibited.

During inflation, the pressure of well bore fluids within chamber 39 and below piston 40 exert an upward force upon fluid piston 40. During the process of inflating packer 120, the weight of the tubing or drill string (including tubular member 36 and piston 40) is lessened by the upward force exerted by compressed fluid within chamber 39. Thus, the operator of the well workover rig at the surface of the earth is constantly aware if packer 120 is being properly inflated. Should an insignificant portion of the drill string weight not be transferred from the surface workover rig to the inflatable packer assembly during inflation, the operator immediately becomes aware that a fluid leak has developed within the inflatable packer assembly of the present invention at a location below fluid piston 40, and thus, that packer 120 is not being properly inflated. The assembly can then be pulled to the surface for damage evaluation and repair or reconstruction.

As inflated, element 124 forms a fluid tight seat against a cased or uncased well bore and prevents fluid communication within the annulus defined between the tubing string and inflatable packer assembly 120. Thus, the inflated element 124 isolates an interval of the well bore below packer assembly 120 and the subterranean formation surrounding the isolated well bore interval for treatment by injection of fluid through the tubing or drill string and inflatable packer assembly 10 via passageway 12.

After treatment of the desired well bore and/or subterranean formation interval, the tubing or drill string is raised at the surface causing tubular member 36 and fluid piston 40 to be raised. As fluid piston 40 is raised within chamber 39, fluid is withdrawn from inflated packer 120 into chamber 39. Fluid is withdrawn solely from inflated packer 120 into chamber 39 until fluid piston 40 is moved upwardly to uncover port 34. Further upward movement of fluid piston 40 causes fluid from the annulus surrounding inflatable packer assembly 10 to flow through port 69, fluid passageway 63, check valve 64, port 62, fluid passageway 35 and port 34 into chamber 39. Any fluid which is located in chamber 39 above piston 40 is forced from chamber 39 through ports 31 upon upward movement of piston 40. In this manner, a volume of fluid approximately equal to that vented through check valve 161 during inflation of packer 120 is drawn into fluid chamber 39 to supplement that drawn from packer 120 during deflation. Thus, the volume of fluid contained within chamber 39 is sufficient to inflate packer 120 within well bores of varying diameters.

Once packer elements 123, 124 are deflated, lug 38 is repositioned to its original location (FIG. 5) within endless J-slot 51 of sleeve 50 by reciprocation of the tubing string from the surface in a manner as will be evident to the skilled artisan. It is important to note while the drill or tubing string is raised during deflation of packer 120 and repositioning of lug 38, slips 101 withstand an accompanying upward force without movement. Slips 101 are preferably provided with carbide inserts 191 to assist in resisting such upward force. Once lug 38 is secured within slot 51 and tubular member 36 is secured against rotation with respect to inner and outer tubular members 21 and 22, the tubing or drill string is again raised to retract slips 101 in hanger assembly 100 and rotated to secure lug 113 within J-slot 107. With slips 101 retracted and packer 120 deflated, the tubing string can be raised or lowered to reposition the inflatable packer assembly 10 of the present invention adjacent another well bore and/or formation interval to be treated. Slips 101 can then be extended and packer 120 inflated in the manner described above, to isolate the new interval for treatment.

Figure 6:
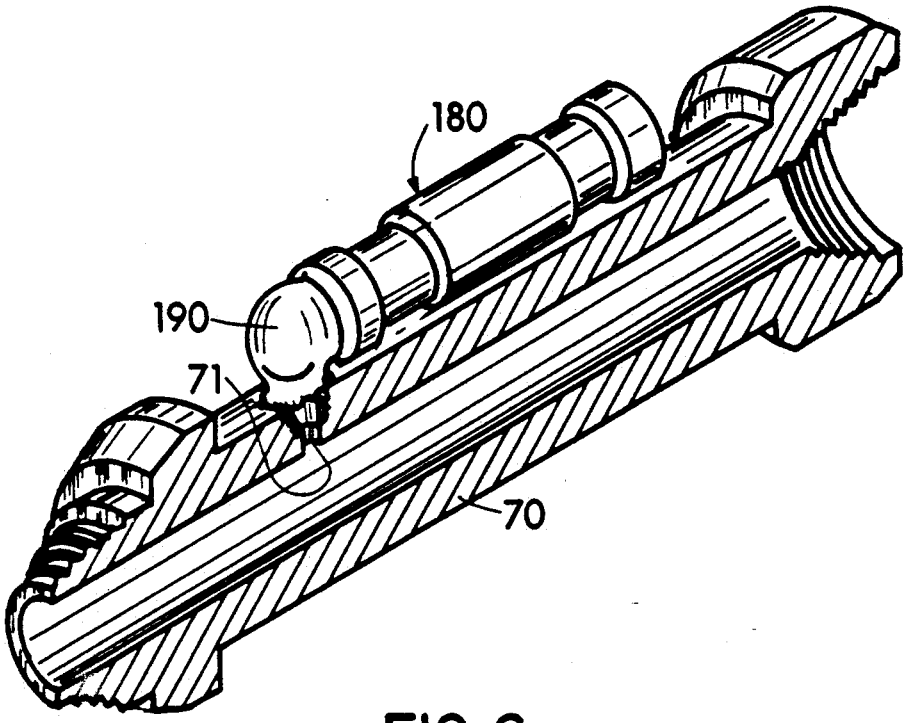
FIG. 6 is a partially sectioned, perspective review of a valve subassembly of one embodiment of the present invention.
Figure 7:
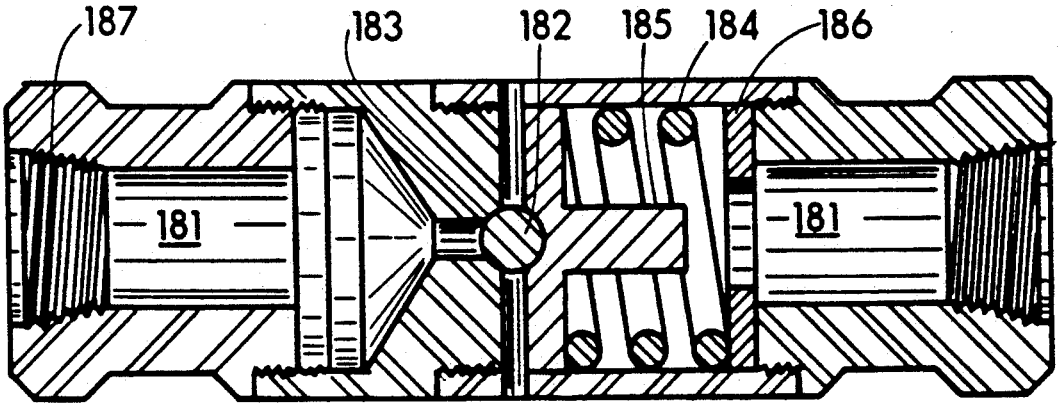
FIG. 7 is a cross sectional view of a pressure compensated valve employed in the valve subassembly illustrated in FIG. 6.

An alternative second check valve is illustrated in FIGS. 6 and 7 generally as 180 and can be employed in lieu of second check valve 161 and its associated fluid passageways through valve sub-assembly 60. Second check valve 180 is secured to an elbow 190 which in turn is threadably secured to a threaded bore 71 provided through the wall of spacing joint 70. Check valve 180 is provided with axial bore 181 therethrough. A ball 182 is urged into sealing engagement with seat 183 by means of spring 184 acting against stem 185 and washer 186. Internal threads 187 are mated with corresponding male threads on elbow 190. Thus, during the downward stroke of fluid piston 40, increasing fluid pressure is transmitted to second check valve 180 by means of the fluid passageway defined by annulus 165. When a predetermined fluid pressure is exerted against ball 182 which is sufficient to overcome the force of spring 184, ball 182 is unseated thereby permitting fluid to flow through axial bore 181 and into the annulus between inflatable packer assembly 10 and the well bore walls or casing. Alternative second check valve 180 is sized and designed to transport higher fluid flow rates than second check valve 161.

Figures 8A, 8B, 8C, 8D, 8E, 8F:
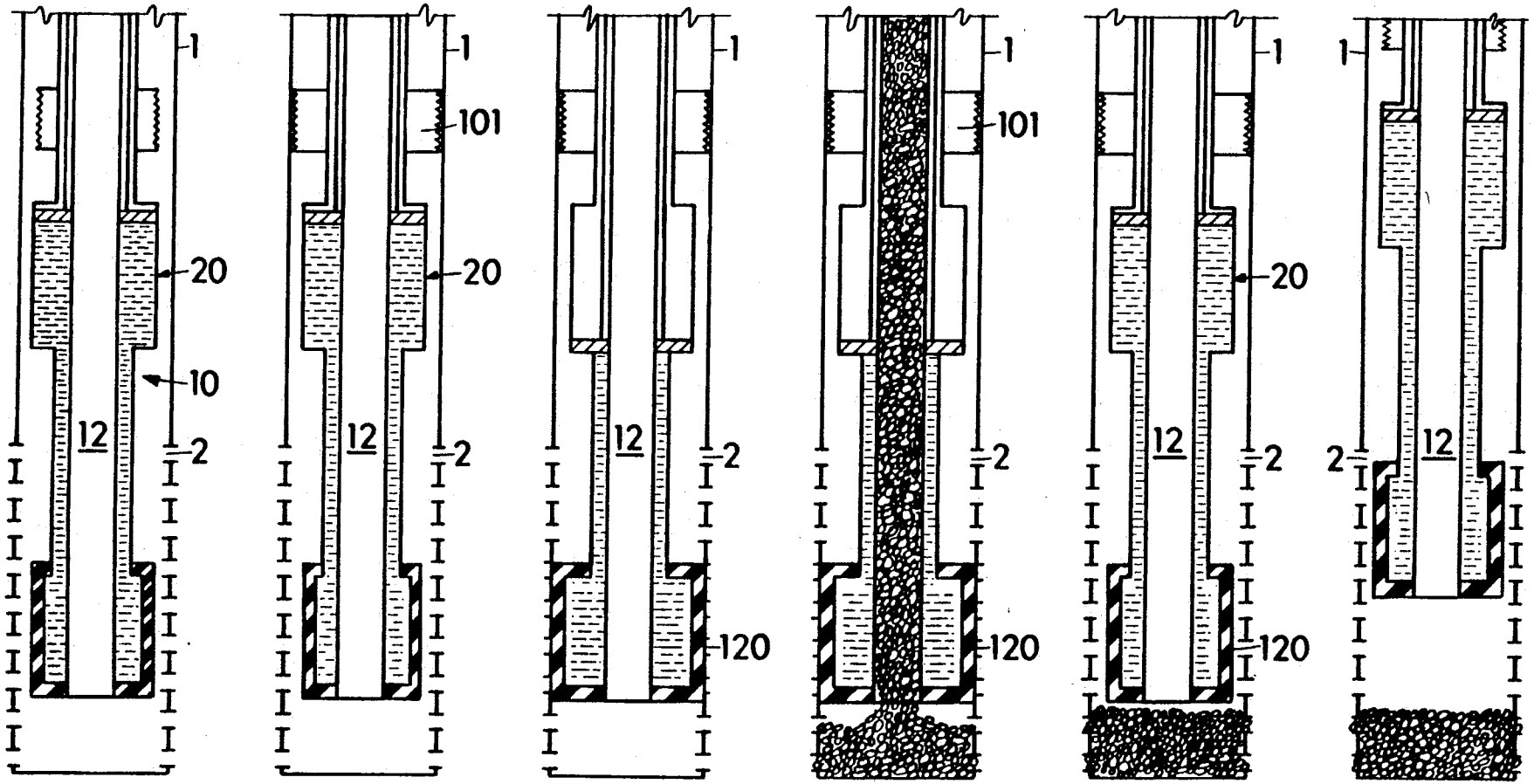
FIGS. 8A-8F are schematic views of the inflatable packer assembly of the present invention as utilized to perform a treating operation.
Figure 9A:
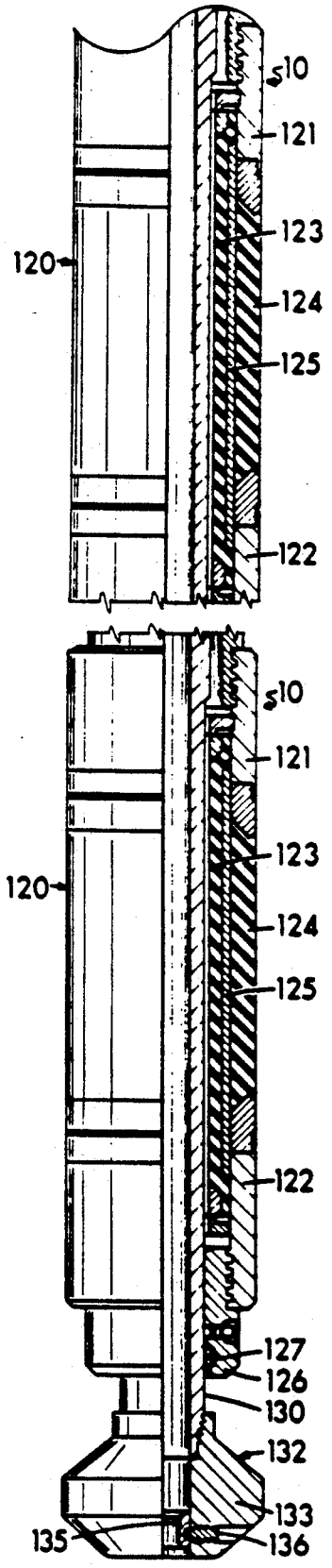
FIG. 9A is a partial cross sectional view which, combined in sequence with FIGS. 1A, 2A, and 3A, illustrates the inflatable packer assembly of the present invention, including two packers, as assembled and run into a well bore.
Figure 9B:
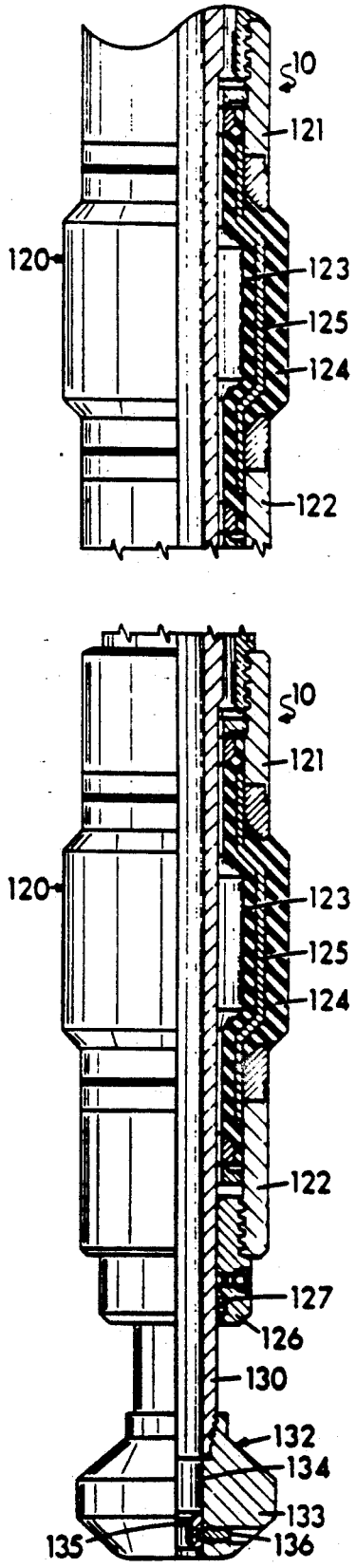
FIG. 9B is a partial cross sectional view which, as combined in sequence with FIGS. 1B, 2B, and 3B, illustrates the inflatable packer assembly of the present invention, including two packers, as positioned in a well bore and fully inflated.

As illustrated in FIGS. 8A–8F, the inflatable packer assembly 10 of the present invention is positioned within a well bore 1 which is in fluid communication at the lower end thereof with a subterranean formation. In the event well bore 1 is provided with casing which is secured within the well bore in a manner as will be evident to the skilled artisan, such as by cement, the casing is provided with a series of perforations 2 to provide fluid communication between the cased well bore and the adjacent subterranean formation. The inflatable packer assembly 10 of the present invention is run into the well bore such that the lower end thereof is adjacent the lowermost interval of the well bore to be treated. As illustrated in FIG. 8B, slips 101 are then set in a manner as described above. Thereafter, and in a manner as described above, packer 120 is inflated (FIG. 8C) and a slurry of fluid having gravel suspended therein is injected through apparatus 10 via passageway 12 into the interval of the well bore to be initially treated (FIG. 8D). Once a gravel prepack has been completely formed in the well bore interval, the packer 120 is deflated as illustrated in FIG. 8E and then slips 101 are retracted and the tubing string and inflatable packer assembly 10 of the present invention are raised as illustrated in FIG. 8F. The operation illustrated in FIGS. 8A–8F is repeated until the entire well bore interval in fluid communication with the subterranean formation has a gravel prepack formed therein. Although the entire well bore interval to be treated utilizing the inflatable packer assembly of the present invention can be extremely long, e.g., 200 to 300 feet, it is preferred to sequentially treated intervals of approximately 5 to 10 feet beginning with the bottom of the well bore interval to be treated.

Figure 3A:
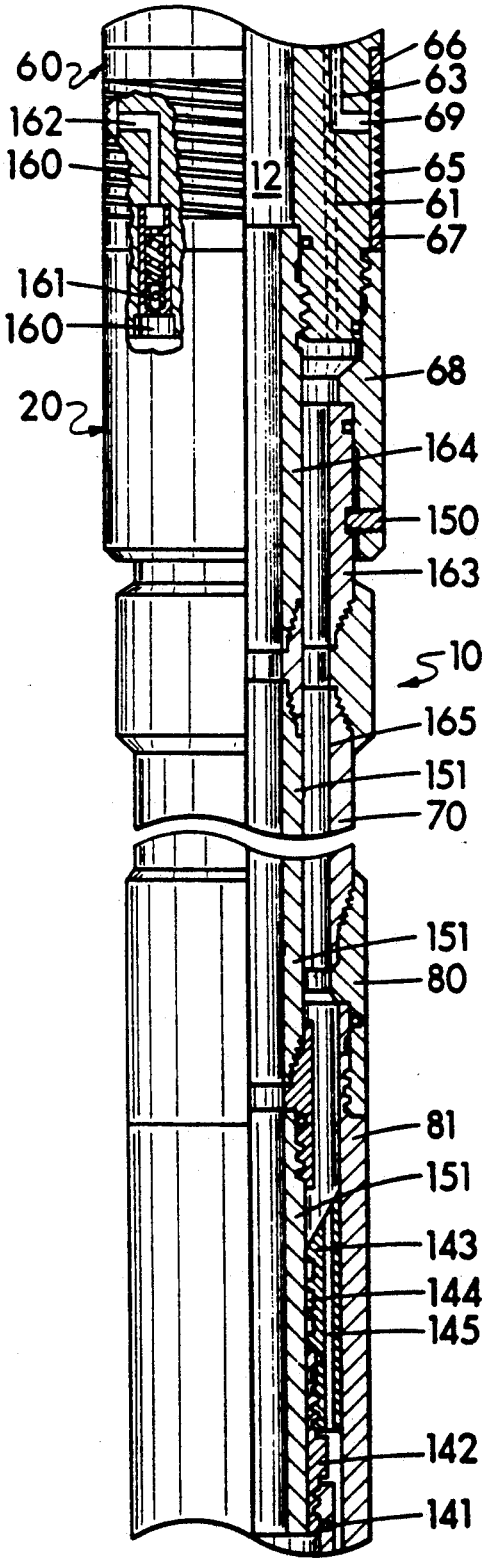
Figure 3B:
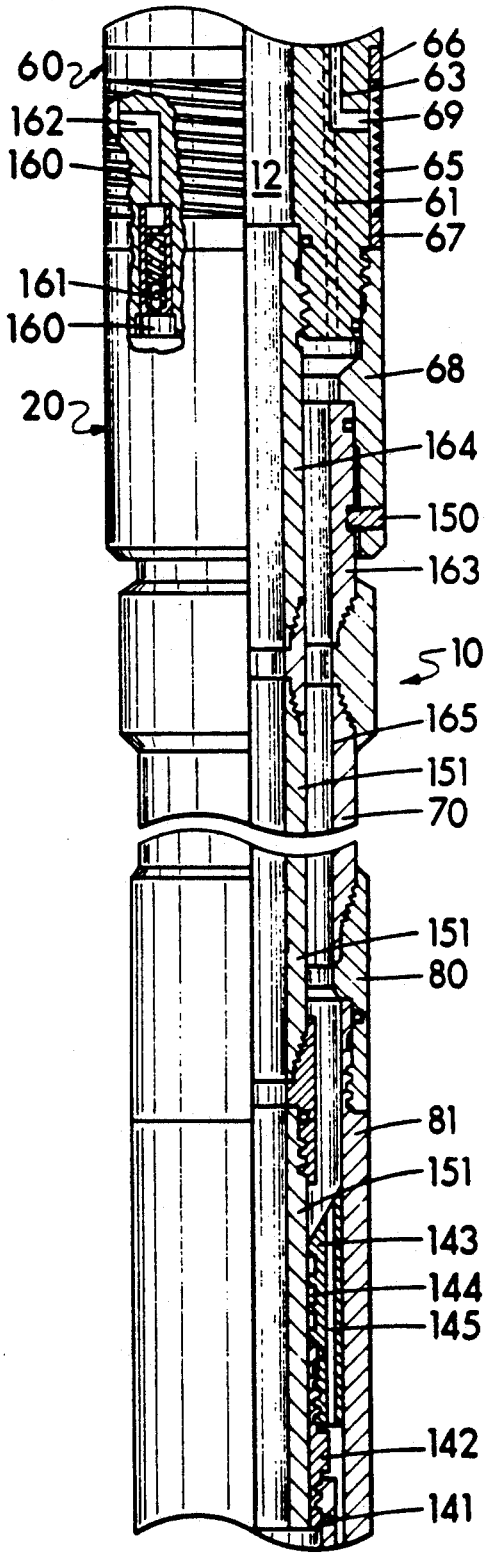

The relatively long length of inflatable element 124 of packer 120, e.g., about 4 to about 10 feet, functions to prevent most material, such as gravel or unconsolidated formation sand, from entering the well bore via perforations 2 above the inflated packer during such gravel prepacking or other treating operation. Thus, when the packer 120 is deflated, the packer should not become stuck in the well bore upon raising the tubing string to reposition apparatus 10. However, in the event the inflatable packer 120 should become stuck in the well bore, a shear pin 150 (illustrated in FIGS. 3A and 3B) is provided. Application of sufficient upward force upon inflatable packer assembly 10 by raising the tubing or drill string would cause pin 150 to shear leaving packer 120 within the well bore for a subsequent fishing or removal operation. In this manner, the expense of replacing components of an inflatable packer assembly which may become stuck in a well bore during a given operation is greatly reduced.

While the operation of the inflatable packer assembly 10 of the present invention has been described above in relation to a treating operation for forming a gravel prepack in a well bore, it will be evident to the skilled artisan that the inflatable packer assembly of the present invention can be utilized in any well bore treating operation in which it is desired to isolate an interval of the well bore and/or formation for treatment. The inflatable packer assembly of the present invention could be used to fracture a given interval, e.g., a 5 to 10 foot interval, of a subterranean formation. Or could be used to stimulate, e.g., acidize, a given interval of the subterranean formation. Such fracturing or stimulation processes could be practiced prior to gravel prepacking the well bore in a manner as described above. The same slurry of gravel and fluid which is used to fracture a well bore could be also utilized to form a gravel prepack in the well bore. It will be evident to the skilled artisan that only the perforations in a cased well bore could selectively prepack during a given gravel operation or the entire well bore can be gravel prepacked and subsequently drilled out so that other completion operations can be practiced. The gravel utilized in a given gravel prepack operation can be resin coated to impart greater strength to the gravel prepack. The inflatable packer assembly of the present invention can be utilized to isolate an interval of a horizontal well bore or any other deviated well bore.

Although the inflatable packer assembly has been illustrated and described as inflating one packer, it will be evident to the skilled artisan that the fluid piston assembly 20 of the present invention can be utilized to inflate multiple packers which depend from the packer 120 and are in fluid communication with fluid chamber 39 by any suitable means. Thus, the inflatable packer assembly 10 of the present invention can be modified to include at least two inflatable packers so that conventional straddle pack operations can be conducted to isolate a given subterranean zone or interval as will be evident to the skilled artisan.

While the foregoing preferred embodiments of the invention have been described and shown, it is understood that the alternatives and modifications, such as those suggested and others, may be made thereto and fall within the scope of the invention.

We claim:

1. An inflatable packer assembly for use in an enclosure having a substantially tubular configuration, the assembly comprising:

securing means for securing the assembly against axial movement within the substantially tubular enclosure;

inflatable means for forming a fluid tight seal between the assembly and the enclosure upon being inflated thereby substantially preventing fluid flow through an annulus defined between the assembly and the enclosure;

pump means for mechanically pumping fluid which is initially present within the enclosure to and from said inflatable means;

positioning means for fixedly positioning said securing means and said pump means at a location which is sufficiently distant from said inflatable means to inhibit material entering the enclosure from contacting and causing the securing means and pump means to become stuck within the enclosure; and means for axially transporting fluid through the assembly.

2. The assembly of claim 1 further comprising:

valve means for preventing said pump means from overinflating said inflatable means.

3. The assembly of claim 1 wherein said securing means comprises a plurality of slip elements which can be radially expanded into contact with the enclosure.

4. The assembly of claim 1 wherein said positioning means comprises an inner tubular member and an outer tubular member telescopically arranged and secured to said pump means and said inflatable means, said inner and said outer tubular members defining an annulus therebetween for conveying fluid between said pump means and said inflatable means.

5. The assembly of claim 1 further comprising:

pump securing means for releasably securing said pump means against movement thereby preventing said pump means from pumping fluid.

6. The assembly of claim 5 wherein said pump means comprises:

an inner generally tubular member;

an outer generally tubular member telescopically arranged about said inner tubular member to define a fluid chamber therebetween; and a piston positioned within said fluid chamber said piston initially restrained from moving within said chamber by said pump securing means.

7. The assembly of claim 6 further comprising:

a third generally tubular member secured to said piston and positioned between said inner and said outer generally tubular members.

8. The assembly of claim 7 wherein said securing means comprises:

a sleeve rotatably positioned about said third tubular member, said sleeve having an endless J-slot formed in the outer surface thereof; and a lug secured to and extending inwardly from said outer tubular member and received within said endless J-slot, said lug capable of being removed from said endless J-slot upon manipulation of said third tubular member.

9. The assembly of claim 1 wherein said enclosure is a well bore.

10. The assembly of claim 1 wherein said enclosure is a cased well bore.

11. The assembly of claim 4 further comprising:

shear means for releasably securing said inflatable means and said outer tubular member to said pump means.

12. The assembly of claim 1 further comprising:

first valve means for transporting fluid from the enclosure into said pump means as said pump means is pumping fluid from said inflatable means.

13. The assembly of claim 1 further comprising:

valve means for transporting fluid from the pump means to the enclosure as said pump means is pumping fluid to the inflatable means.

14. The assembly of claim 1 further comprising:

second inflatable means for forming a fluid tight seal between the assembly and the enclosure upon being inflated by fluid pumped from said pump means, said second inflatable means being spaced from said inflatable means.

15. A process for treating an interval of a well bore which is in fluid communication with a subterranean formation, the process comprising:

a) securing an inflatable packer assembly to a string of tubing, said assembly comprising securing means for securing the assembly against axial movement within the well bore, inflatable means for forming a fluid tight seal between the assembly and the well bore upon being inflated thereby substantially preventing fluid flow through an annulus defined between the assembly and the well bore and pump means for mechanically pumping fluid which is initially present within the well bore to and from said inflatable means;

b) positioning said inflatable means adjacent the well bore interval to be treated, the assembly being constructed such that said securing means and said pump means being positioned at a location distant from the interval to be treated;

c) expanding the securing means into contact with the well bore by manipulation of the tubing string to secure the assembly against axial movement within the well bore;

d) manipulating the tubing string to pump said fluid from the pump means to the inflatable means thereby inflating the inflatable means to form said fluid tight seal and to isolate the well bore interval; and e) injecting a treating fluid through the assembly and into contact with the well bore interval to be treated.

16. The process of claim 15 further comprising:

f) manipulating the tubing string to pump said fluid from the inflatable means to the pump means thereby breaking said fluid tight seal;

g) retracting the securing means by manipulation of the tubing string to permit axial movement of the assembly within the well bore;

h) repositioning said inflatable means adjacent a separate well bore interval to be treated; and i) sequentially repeating steps c), d) and e).

17. The process of claim 15 wherein said treating fluid is a gravel slurry which forms a gravel prepack within the well bore interval to be treated.

18. The process of claim 17 wherein said well bore is deviated.

19. The process of claim 15 wherein said treating fluid is an acidic solution.

20. The process of claim 19 wherein said well bore is deviated.

21. The process of claim 19 wherein said acidic solution penetrates and stimulates a portion of the subterranean formation adjacent the well bore interval.

* * * * *